US007281818B2

(12) United States Patent
You et al.

(10) Patent No.: US 7,281,818 B2
(45) Date of Patent: Oct. 16, 2007

(54) LIGHT REFLECTOR DEVICE FOR LIGHT EMITTING DIODE (LED) ARRAY

(75) Inventors: Chenhua You, Manasquan, NJ (US); Mohamed Abdelhafez, Old Bridge, NJ (US); Yubo Yang, Princeton Junction, NJ (US); Anthony Verdes, Brick, NJ (US); Markus Lomberg, Ergolding (DE); Michael Hertrich, Freising (DE)

(73) Assignee: Dialight Corporation, Farmingdale, NJ (US)

( * ) Notice: Subject to any disclaimer, the term of this patent is extended or adjusted under 35 U.S.C. 154(b) by 0 days.

(21) Appl. No.: 10/732,513

(22) Filed: Dec. 11, 2003

(65) Prior Publication Data

US 2005/0128744 A1 Jun. 16, 2005

(51) Int. Cl.
*F21V 7/04* (2006.01)

(52) U.S. Cl. ..... 362/241; 362/238; 362/240; 362/247; 362/346; 362/348; 257/88; 257/98

(58) Field of Classification Search ..... 362/238, 362/241, 346, 227, 235, 236, 237, 240, 249, 362/317, 341, 347, 348, 350, 800, 247; 257/87, 257/88, 98; 313/500
See application file for complete search history.

(56) References Cited

U.S. PATENT DOCUMENTS 3,539,801 A * 11/1970 Bobrick ..... 362/297
4,254,453 A * 3/1981 Mouyard et al. ..... 362/240
4,271,408 A * 6/1981 Teshima et al. ..... 362/240
4,336,580 A * 6/1982 Mouyard et al. ..... 362/347
4,628,422 A * 12/1986 Ewald ..... 362/240
4,733,335 A * 3/1988 Serizawa et al. ..... 362/503
4,847,734 A * 7/1989 Katoh et al. ..... 362/249
4,935,665 A * 6/1990 Murata ..... 362/240
4,941,072 A * 7/1990 Yasumoto et al. ..... 362/249
4,975,814 A * 12/1990 Schairer ..... 362/241
5,093,768 A * 3/1992 Ohe ..... 362/241
5,226,723 A * 7/1993 Chen ..... 362/241
5,418,384 A * 5/1995 Yamana et al. ..... 257/88
5,534,718 A * 7/1996 Chang ..... 362/347
5,580,156 A * 12/1996 Suzuki et al. ..... 362/241
5,660,461 A * 8/1997 Ignatius et al. ..... 362/241
5,903,768 A 5/1999 Sato
6,069,676 A * 5/2000 Yuyama ..... 349/62
6,106,137 A * 8/2000 Adams et al. ..... 362/237

(Continued)

FOREIGN PATENT DOCUMENTS

EP 1 030 099 8/2000

(Continued)

*Primary Examiner*—Jong-Suk James Lee
*Assistant Examiner*—Ismael Negron
(74) *Attorney, Agent, or Firm*—Oblon, Spivak, McClelland, Maier & Neustadt, P.C.

(57) ABSTRACT

A reflector device to be utilized with light emitting diodes (LEDs), and particularly with high-flux LEDs. In the reflector structure individual reflector portions surround at least one LED. Light output from each individual LED is reflected by sloping walls of each individual reflector portion and is redirected. As a result, light that may otherwise be lost is redirected to a more useful direction. Each individual reflector portion can have a cross-section of a conic shape, a complicated curve, and can also be oval in shape. A light device is realized by utilizing such a master reflector with an LED light source.

21 Claims, 13 Drawing Sheets

U.S. PATENT DOCUMENTS 6,367,949 B1 * 4/2002 Pederson ..... 362/240
6,552,658 B1 4/2003 Roller et al.
6,578,994 B1 * 6/2003 Beyerlein ..... 362/238
6,611,000 B2 * 8/2003 Tamura et al. ..... 257/88
6,641,284 B2 * 11/2003 Stopa et al. ..... 362/240
6,799,864 B2 * 10/2004 Bohler et al. ..... 362/236
6,814,470 B2 * 11/2004 Rizkin et al. ..... 362/240

FOREIGN PATENT DOCUMENTS

JP 410049074 A * 2/1998

* cited by examiner

LIGHT REFLECTOR DEVICE FOR LIGHT EMITTING DIODE (LED) ARRAY

FIELD OF THE INVENTION

The present invention is directed to reflectors to utilize with light emitting diodes (LEDs), and particularly when the LEDs are high-flux LEDs.

DISCUSSION OF THE BACKGROUND

High-flux LEDs are becoming more and more prevalent. A high-flux LED is generally an LED with greater luminous output in comparison with earlier developed traditional 5 mm LEDs, and an LED that has a larger size chip than in the traditional 5 mm LED. A high-flux LED for the purposes of this disclosure is defined as an individual LED package that is capable of dissipating more than 0.75 watts of electric power. With improvement in high-flux LED technology, more and more companies are developing different types of high-flux LEDs. High-flux LEDs also typically have larger viewing angles in comparison with a traditional 5 mm LED. To use such high-flux LEDs efficiently, mechanisms have been provided to redirected light output from the larger viewing angle of the high-flux LEDs. One known way to use the light output from high-flux LEDs more efficiently is to use a reflective/refractive lens to redirect output light. That approach has been utilized by companies such as Lumileds, Osram, and Fraen, etc.

SUMMARY OF THE INVENTION

However, the applicants of the present invention recognized that a significant drawback exists in utilizing such a reflective/refractive lens. Such a reflective/refractive lens is a plastic lens, and one major drawback of utilizing such a plastic lens is that the lens is usually very bulky. That results in limiting the LED packing density and makes the LED difficult to mount.

Accordingly, one object of the present invention is to address the above-noted and other drawbacks in the background art.

Another object of the present invention is to provide novel reflectors to be utilized with LEDs, and which may find particular application with high-flux LEDs. Such novel reflectors are small in size and easy to utilize.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIGS. 7*a*1, 7*a*2, 7*a*3 show detailed views of a reflector of a further embodiment of the present invention;

FIGS. 8*a*1, 8*a*2 show detailed views of a reflector of a further embodiment of the present invention;

DESCRIPTION OF THE PREFERRED EMBODIMENTS

Figure 1A:
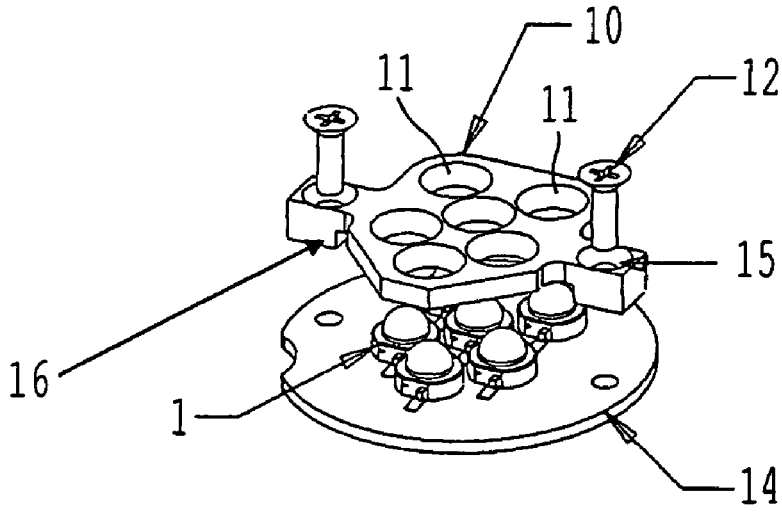
FIGS. 1*a*-1*c* show a first embodiment of the present invention.

In the following description to the drawings, like reference numerals designate identical or corresponding parts throughout the several views.

As discussed above, the applicants of the present invention recognized that high-flux LEDs typically have larger viewing angles in comparison with traditional 5 mm LEDs, and that a background approach to utilizing a reflective/refractive lens to redirect light from plural high-flux LEDs has a drawback in making an overall light device bulky and difficult to mount.

To address such drawbacks in the background art, the present inventors realized that enhanced packing density and mountability could be realized by utilizing a reflector for LEDs in which each LED, or at least a group of LEDs, fits into its own reflector portion. Such a structure allows high redirection of light from each individual LED in a device that is not very bulky and that is not difficult to mount. The present invention is particularly applicable to high-flux LEDs because high-flux LEDs have large viewing angles. Further, high-flux LEDs are typically utilized in systems in which fewer LEDs are provided, making it more feasible to provide an individual reflector for each LED.

Figure 1B:
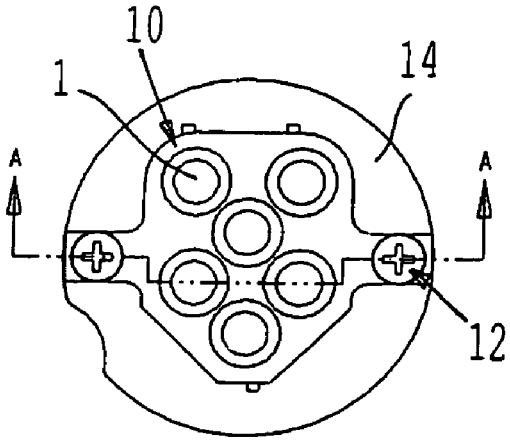
Figure 1C:
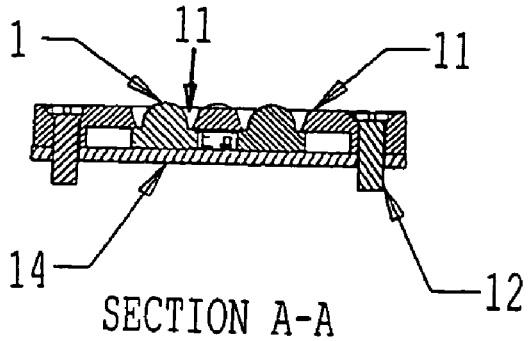

A first embodiment of the present invention is shown in FIGS. 1*a*-1*c*.

As shown in FIGS. 1*a*-1*c* a plurality of high-flux LEDs 1 are mounted onto an LED printed circuit board 14. In the embodiment shown in FIGS. 1*a*-1*c* a master reflector device 10having individual reflecting portions or reflectors 11 is provided. Those individual reflectors 11 are provided to each surround one respective high-flux LED 1. That is, in this embodiment of the present invention each LED 1 is surrounded by a respective reflector 11 of the master reflector device 10.

As shown most clearly in FIG. 1*c*, each individual LED 1 fits inside an individual reflector 11 and walls of the reflector 11 are sloped with respect to the LED 1. That allows light output from sides of the LED 1 to be efficiently reflected. High-flux LEDs have a large viewing angle, meaning that they emit a larger amount of light in divergent directions. By utilizing the master reflector 10 of FIG. 1 light can be reflected by the sloped walls of the individual reflectors 11, which light would otherwise not be viewed.

The reflector device 10 may be made of molded plastic and may have an aluminum coating coated on the reflective wall surfaces of the individual reflectors 11. With such a structure the reflective surfaces can reflect a portion of light from each individual high-flux LED 1 that would otherwise be lost.

As shown in FIGS. 1*a*-1*c*, the master reflector device 10 also includes holes 15 through which mounting screws 12 are passed to mount the master reflector 10 to the LED printed circuit board 14. Further, the master reflector device 10 includes a step 16. The size of the step 16 is chosen so that when the master reflector 10 is mounted on the LED printed circuit board 14, each individual reflector 11 is at the appropriate height relative to the LED 1 surrounded by the individual reflector 11. FIG. 1*c* specifically shows from a side view the mounting of the master reflector 10 so that each individual reflector portion 11 is at the appropriate height relative to each high-flux LED 1.

Figure 2A:
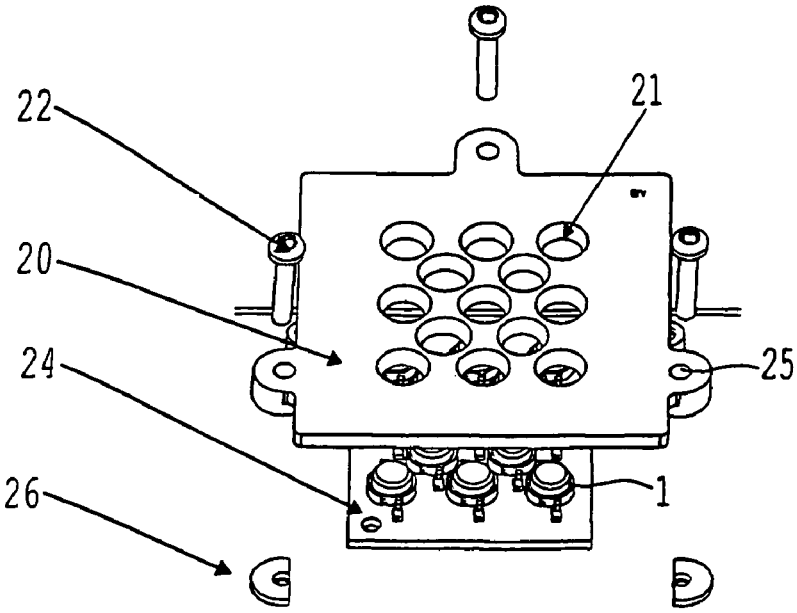
FIGS. 2*a*-2*c* show a further embodiment of the present invention.
Figure 2B:
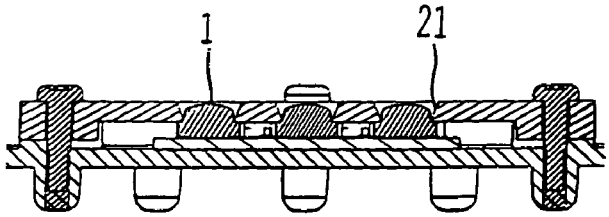
Figure 2C:
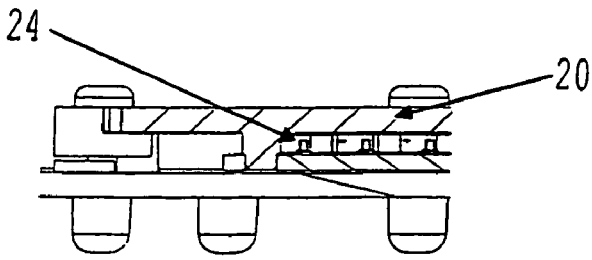

FIGS. 2*a*-2*c* show a further embodiment of the present invention, which shows a master reflector 20 of a different shape and with a different mounting structure. In the embodiment of FIG. 2 the master reflector 20 is not mounted to the LED printed circuit board 24 by the screws 22 passing through holes 25, but instead the master reflector 20 is mounted to receptacle portions 26 in a lamp housing.

A further implementation of an embodiment of the present invention is shown in FIGS. 3*a*-3*g*. FIGS. 3*a*-3*g* show an embodiment of how the master reflector device of the present invention can be specifically incorporated into an LED light device including a lens and the LEDs. In that further embodiment of FIGS. 3*a*-3*g*, the system combining the LEDs and the reflectors includes heat stake features to allow the reflector to be assembled to a lens prior to the LED sub-assembly. Once the lens/reflector sub-assembly is complete, then the LED sub-assembly can be assembled onto a back post of the reflector using screws.

Figure 3A:
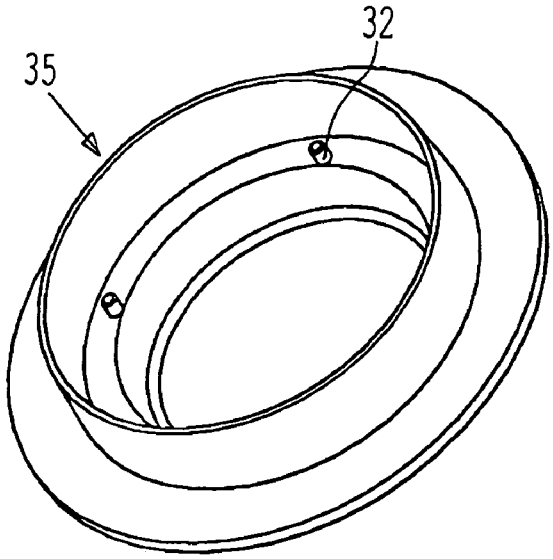
FIGS. 3*a*-3*g* show a further embodiment of the present invention.
Figure 3B:
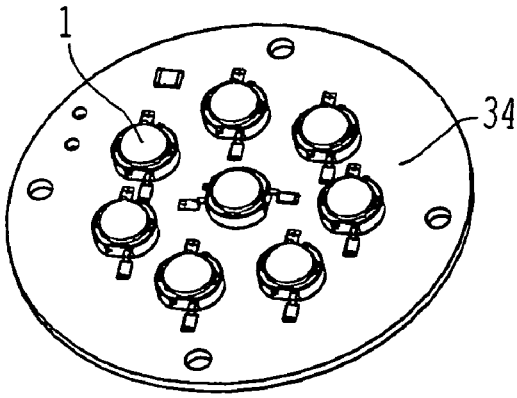
Figure 3C:
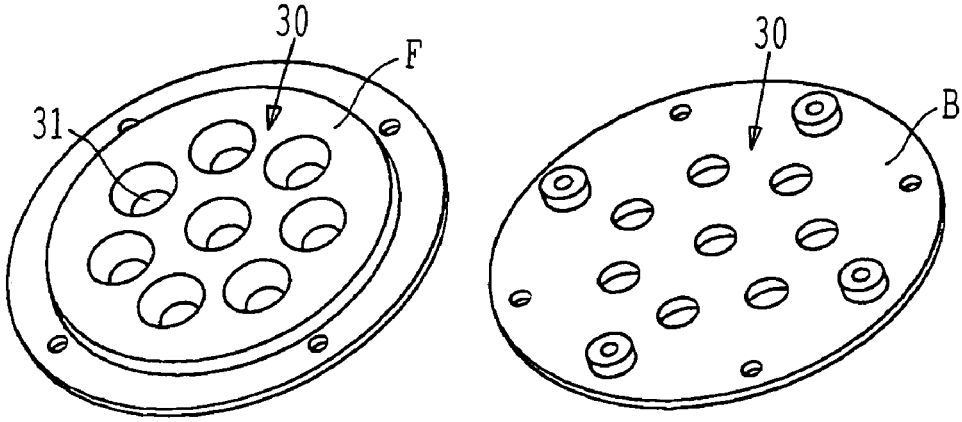

More specifically, FIG. 3*a* shown a lens 35 with heat stakes 32 used for mounting purposes. FIG. 3*b* shows an LED printed circuit board 34 including plural high-flux LEDs 1. FIG. 3*c* shows front F and back B sides of a master reflector 30 with individual reflector portions 31.

Figure 3D:
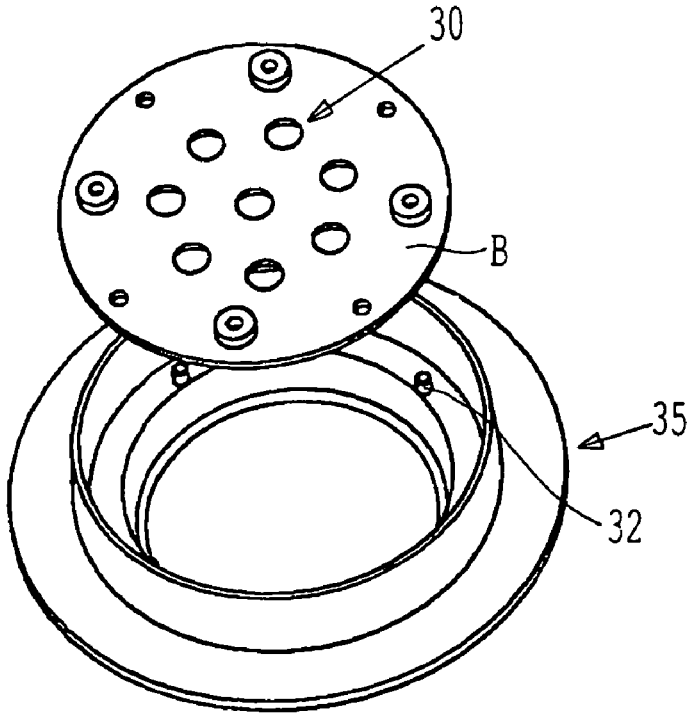
Figure 3E:
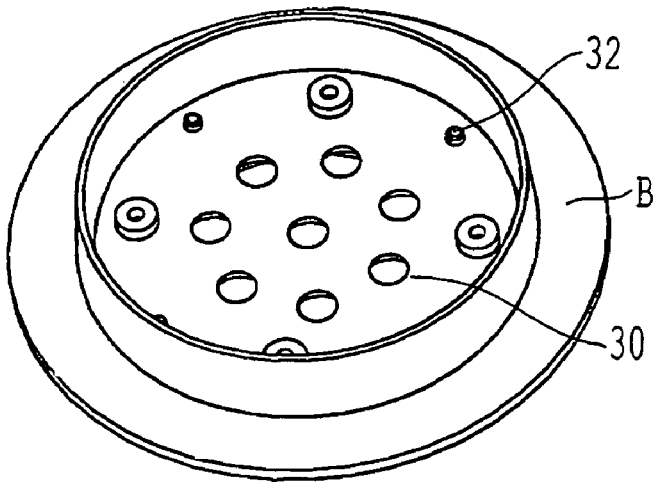

As shown in FIGS. 3*d* and 3*e*, the master reflector 30 is fit inside the lens 35 with the heat stakes 32.

Figure 3F:
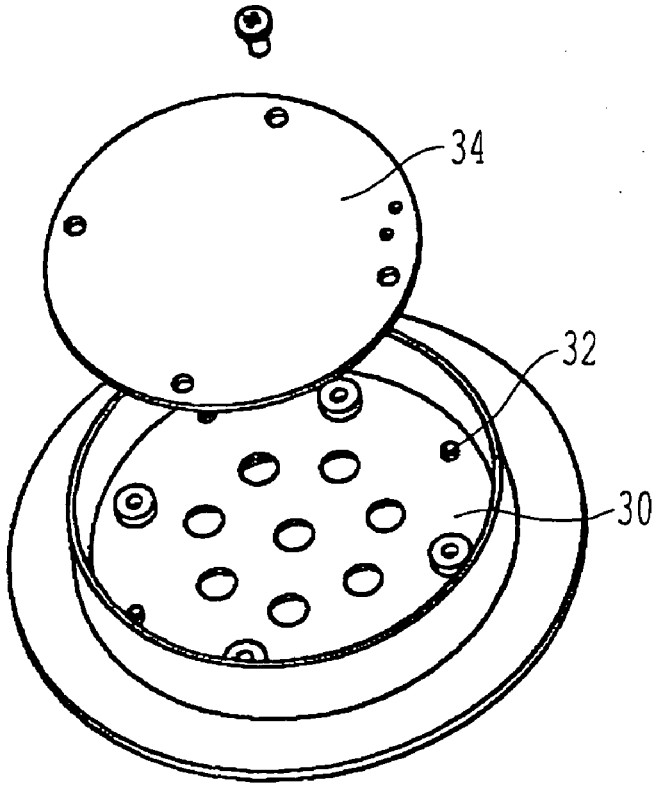
Figure 3G:
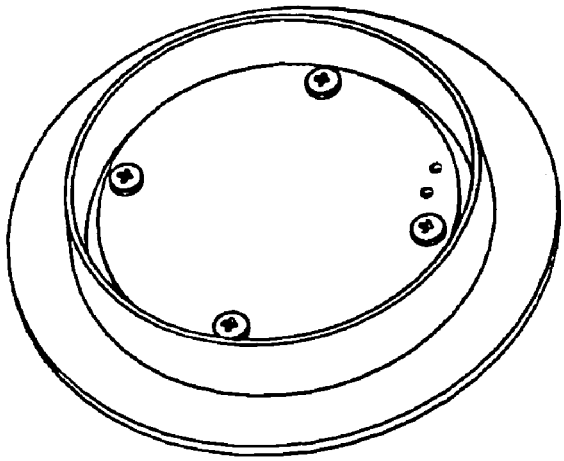

Then, as shown in FIGS. 3*f* and 3*g*, the LED printed circuit board 34 with the LEDs 1, the LEDs 1 not being shown in those figures as they are on the opposite face of the LED printed circuit board 34 (i.e. FIGS. 3*f* and 3*g* show the back side of the LED printed circuit board 34), are then fit into the assembly shown in FIG. 3*e*, so that each individual LED 1 is fit inside one of the individual reflectors reflector portions 31. The overall assembly is then assembled by screws.

Such a further embodiment allows the master reflector 30 to be fit into the lens 35 prior to the LED printed circuit board 34 being fit thereto.

By utilizing the embodiment of FIGS. 3*a*-3*g*, benefits in a manufacturing operation can be achieved. Specifically, utilizing the embodiment of FIGS. 3*a*-3*g* allows a pre-assembly of the lens 35 to the reflector 30, and as a result if desirable an additional heat sink can be assembled to the LED printed circuit board 34 and not to the lens 35. With that structure the lens 35 can be used for a mounting application.

Figure 4A:
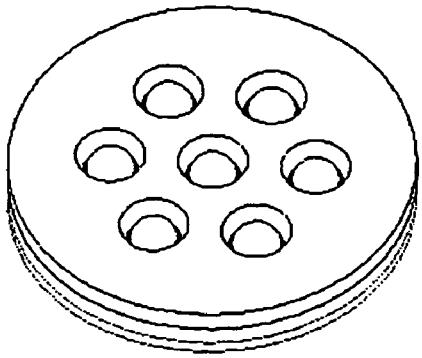
FIGS. 4*a* and 4*b* show specific implementations of embodiments of the present invention.
Figure 4B:
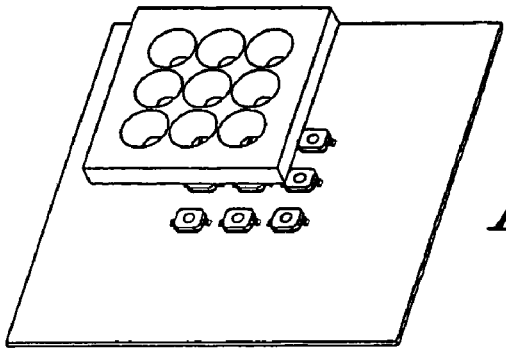

The reflector structures noted in each of the embodiments of FIGS. 1-3 are applicable to different types of LEDs. As examples only, the reflector structures may be utilized with Lumileds LUXEON™ type package LEDs such as shown in the embodiment of FIG. 4*a*, or may also be utilized with surface mounted type package LEDs such as Osram's GOLDEN DRAGON™ LEDs, such as shown for example in FIG. 4*b*. Another example of high-flux LEDs is Nichia's NCCx-series LEDs.

Further, in the embodiments shown in FIGS. 1-3 the shape of each individual reflector 11, 21, 31 can be symmetrical to the optical axis of the individual LEDs 1, although an unsymmetrical shape can also be realized, as discussed in a further embodiment below.

Figure 5A:
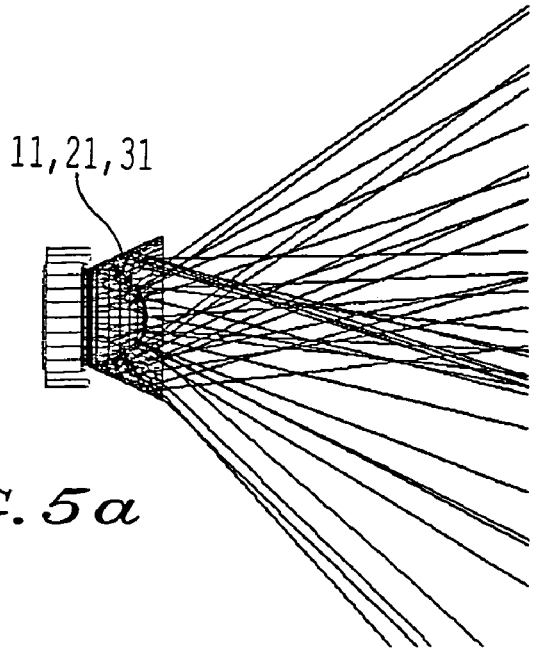
FIG. 5*a* shows a detailed view of a reflector of an embodiment of the present invention.
Figure 5B:
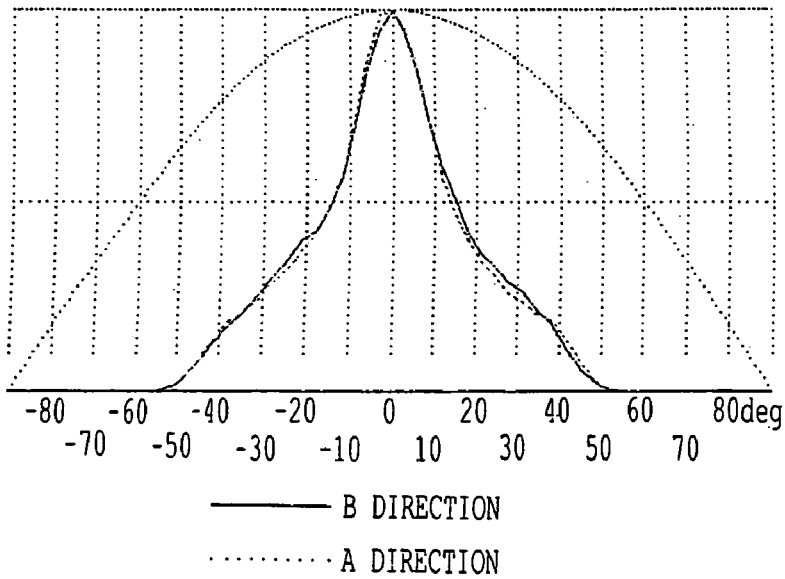
FIG. 5*b* shows results achieved by the embodiment of FIG. 5*a;*

Further, and as shown for example in FIG. 5*a*, the cross-section of each individual reflector 11, 21, 31 may be conic. When utilizing an individual reflector 11, 21, 31 with a conic cross-section as shown in FIG. 5*a*, the output light distribution may have an angular distribution such as shown in FIG. 5*b*.

Figure 6A:
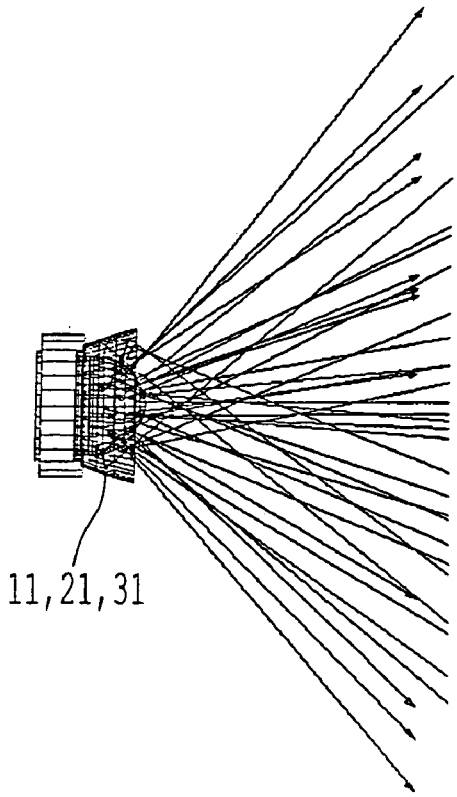
FIG. 6*a* shows a detailed view of a reflector of a further embodiment of the present invention.
Figure 6B:
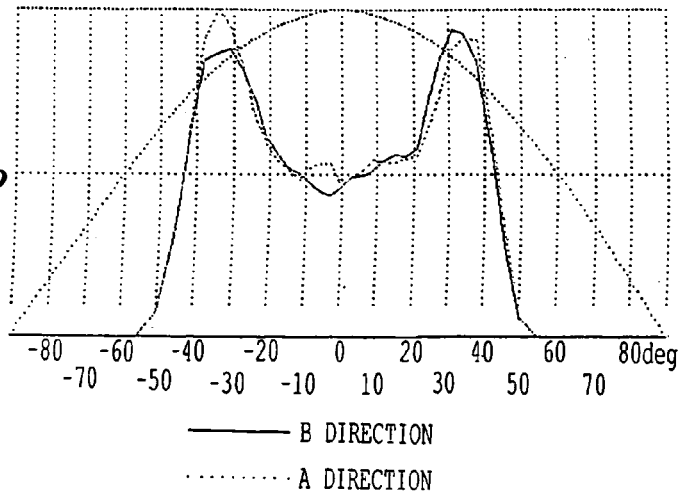
FIG. 6*b* shows results achieved by the embodiment of FIG. 6*a;*

As another possible shape of each individual reflector 11, 21, 31, each individual reflector 11, 21, 31 may have a cross-section of a complicated curve as shown for example in FIG. 6*a*. When utilizing individual reflectors 11, 21, and 31 with such a shape of a complicated curve as shown in FIG. 6*a*, the output light distribution takes the form shown in FIG. 6*b*.

In each of the reflecting surfaces shown in FIGS. 5*a* and 6*a*, a portion of the light output from the high-flux LED 1 propagates to the reflective surfaces of the individual reflectors 11, 21, 31, and the light is reflected to a direction closer to the optical axis of the LED 1. Other portions of the light output from the LED 1 are not interfered with by the reflectors 11, 21, 31 and travel uninterrupted. The divergent angle of the light can be changed by changing the slope or curvature of the reflective surfaces and the height of the reflectors.

Different modifications of the cross-section of each individual reflector 11, 21, 31 can of course be implemented, particularly between the two noted shapes in FIGS. 5*a* and 6*a* to achieve any desired light output.

Figure 7B:
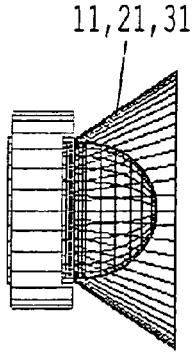
FIGS. 7*b* and 7*c* show results achieved by the embodiment of FIG. 7*a;*
Figure 7B:
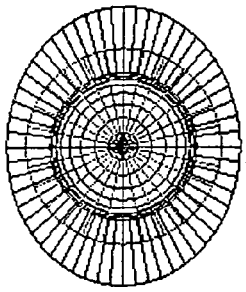
Figure 7B:
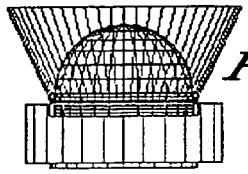
Figure 7B:
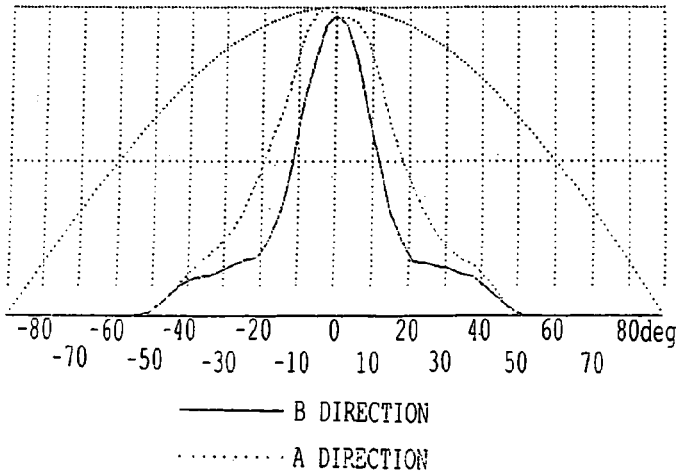
Figure 7C:
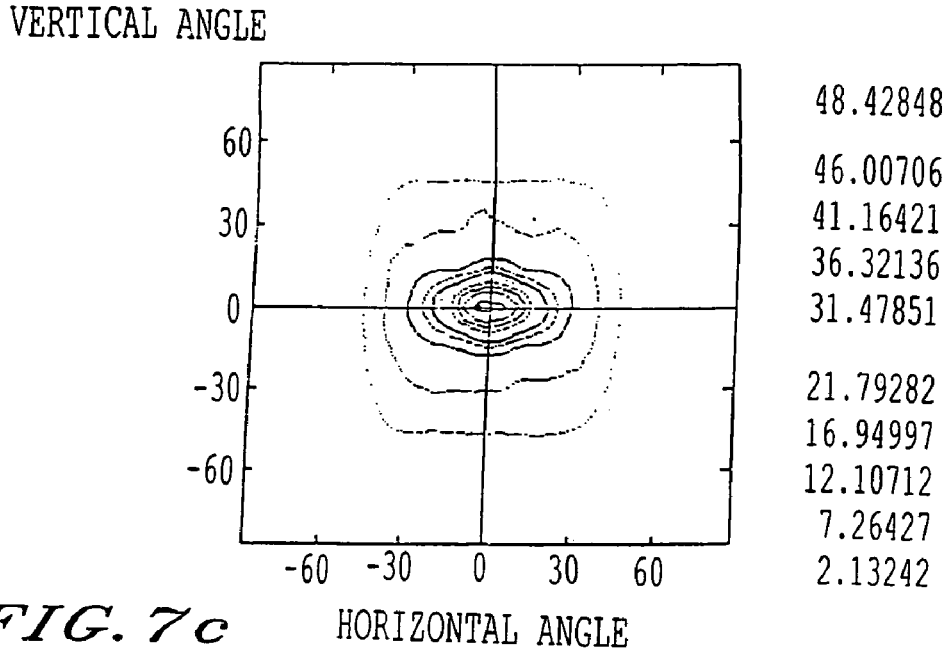

As shown in FIG. 7*a*, the shape of each individual reflector may also be that of an oval. With that shape light as shown in FIGS. 7*b* and 7*c* are output. As shown in FIG. 7*b*, by utilizing an individual reflector 11, 21, 31 with an oval shape an isotropic angular intensity distribution of the output light can be realized. Further, FIG. 7*c* shows the typical angular intensity distribution when utilizing an oval shape individual reflector 11, 21, 31. With such an oval shape the light divergent angles in the two directions perpendicular to the LED axis are different, thereby resulting in an oval shape distribution.

In the embodiments noted above the individual reflector portions 11, 21, 31 are substantially shown as symmetrically shaped with respect to an optical axis of light output by the surrounded LED 1. However, as shown for example in FIG. 8*a* any of the individual reflector portions 11, 21, 31 can be shaped unsymmetrically, i.e. offset from an axis of light output from each individual LED 1.

Figure 8B:
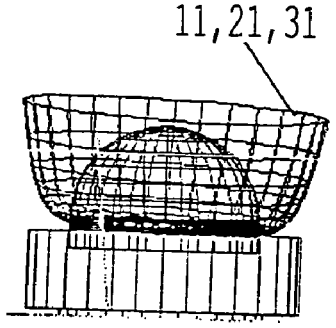
FIGS. 8*b* and 8*c* show possible results achievable by the embodiment of FIG. 8*a;*
Figure 8B:
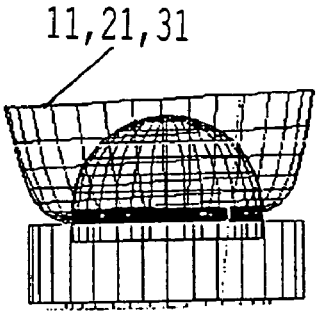
Figure 8B:
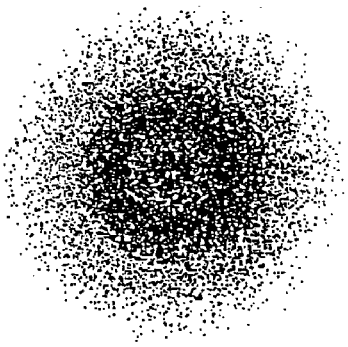
Figure 8C:
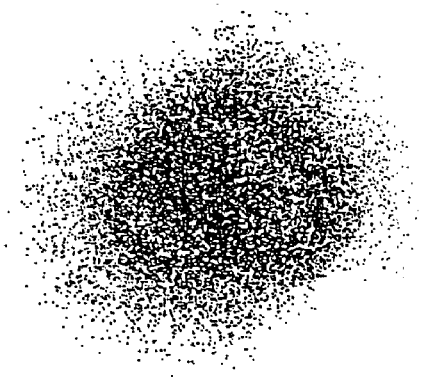

Further, when utilizing unsymmetrically shaped LEDs the individual reflectors of a multi-reflector-device do not have to be identical. As an example, each individual reflector could be tilted at an angle, which slightly differs from the angle of tilt of other individual reflectors. FIGS. 8*b* and 8*c* provide examples of how such a feature can be utilized to obtain a desired light output. FIG. 8*c* shows light output from three adjacent LEDs in which each of the adjacent LEDs is non-tilted. Because each LED is non-tilted the light output from each LED will differ, and as can be seen in FIG. 3*c* three "rings" of output light are realized that are not congruent.

However, if it is desired that the light output from three adjacent LEDs are to be superimposed upon one another, then the three LEDs can be tilted so that the three "rings" of output light could be shifted to overlap and approximate a light output of one more powerful LED, as shown for example in FIG. 8*b*. Utilizing such a feature can be important in signals and lamps with a secondary optic in the range of the light-sources near field. In that environment, by tilting the reflectors from adjacent LED the light can be concentrated on the secondary optic.

The individual reflectors can be tilted to be unsymmetrical with respect to an axis of the light output of the LED in any desired manner, and FIGS. 8*a*-8*c* only show examples of such an operation.

Each of the embodiments noted above shows each high-flux LED 1 surrounded by an individual reflector 11, 21, or 31.

Figure 9A:
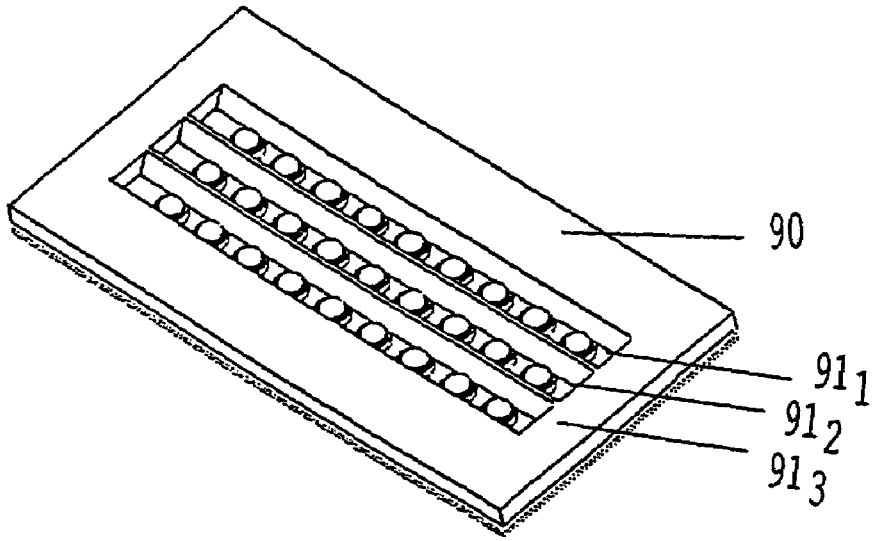
FIG. 9*a* shows a further embodiment of a reflector structure of the present invention.

However, a usage may be desired in which only one direction of a light beam needs to be compressed while the other direction may be preferably left unchanged. In that situation a two-dimensional reflector such as shown in FIG. 9*a* can be utilized. In the two-dimensional reflector shown in FIG. 9*a* a master reflector 90 includes three individual reflector portions $\mathbf{91}_1$, $\mathbf{91}_2$, and $\mathbf{91}_3$. Each individual reflector portion $\mathbf{91}_1$, $\mathbf{91}_2$, and $\mathbf{91}_3$ surrounds plural LEDs set forth in a linear configuration. As noted above, with such a structure only one direction of the light beam is compressed while the other direction is unchanged.

Figure 9B:
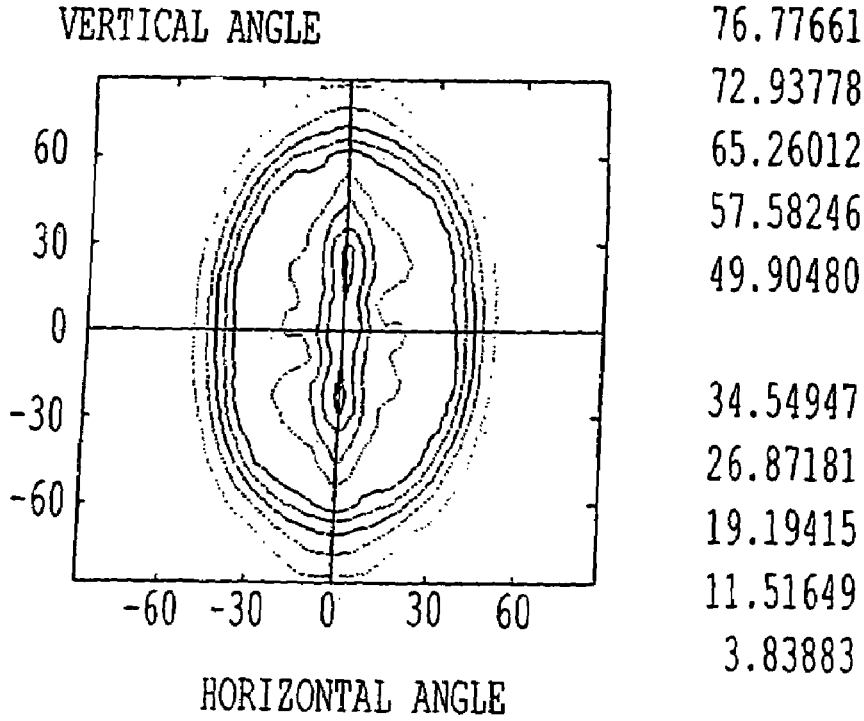
FIG. 9*b* shows results achieved by the embodiment of FIG. 9*a;*

The typical angular intensity distribution of light output by the embodiment of FIG. 9*a* is shown in FIG. 9*b*.

By utilizing the LED reflectors in the present invention light that may otherwise not be utilized can be effectively redirected to increase the performance of LEDs.

The applicants of the present invention have also recognized that it may be beneficial in any of the LED structures noted above to reduce the reflection of impinging light, for example from sunlight impinging on the reflectors and/or the LEDs, i.e. to reduce the sun phantom-effect.

Figure 10:
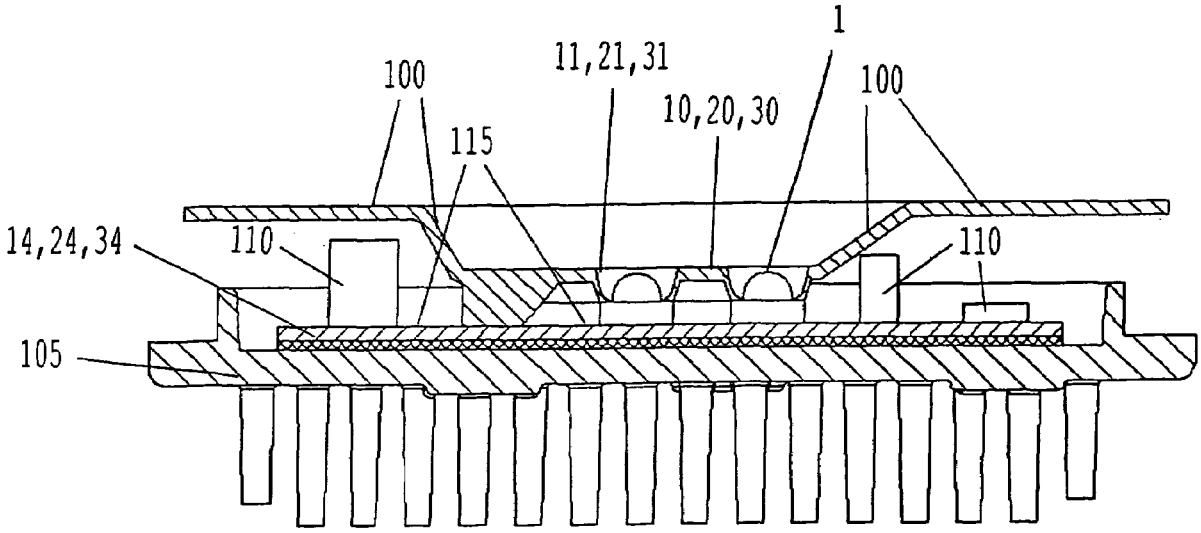
FIG. 10 shows details of a further embodiment of the present invention.

With reference to FIG. 10 in the present specification, a structure for achieving that result is shown.

FIG. 10 shows the structure in which LEDs 1 are mounted on a LED printed circuit board 14, 24, 34, which can correspond to any of the LED printed circuit boards 14, 24, 34 in any of the embodiments noted above, and also with any needed modifications. A master reflector 10, 20, 30 with individual reflector elements 11, 21, 31 is provided around the LEDs 1. As shown in FIG. 10, in such a structure the LED board 14, 24, 34 is mounted onto a structure 105 with heat sink properties. Further, various electronic devices 110 for driving the LEDs are also provided. Blank soldering joints/pads 115 are also utilized in such a structure to provide soldering, contact pads, etc.

In such a structure as in FIG. 10 impinging light, for example from sunlight or from other sources, would conventionally be reflected off of the blank soldering joints/pads 115 and electronic devices 110. However, the present invention avoids that result by providing light absorbing members 100 as an extension of the master reflectors 10, 20, 30. The light absorbing members 100 extend above the electronic devices 110 and the blank soldering joints/pads 115. As a result phantom light can be reduced since impinging light will not be reflected from the blank soldering joints/pads 115 and electronic devices 110, but instead will be absorbed by the light absorbing members 100. Those members 100 can be formed of any non-reflective material.

Figure 11A:
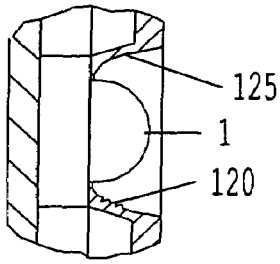
FIGS. 11*a*-11*c* show views of further embodiments of the present invention.
Figure 11B:
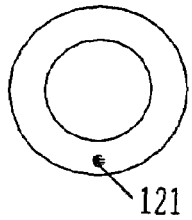
Figure 11C:
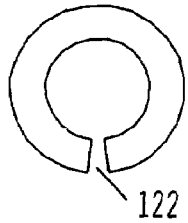

In the embodiments noted above each individual reflector 11, 21, 31 has sloped walls which can be coated with the reflective material such as aluminum. However, it may be desirable in each individual reflector to provide an antireflection portion to reduce the reflection of incident extraneous light, for example sunlight. Different structures to achieve that result are shown in FIGS. 11*a*-11*c*. In each of these figures an anti-reflection area is provided at a portion of the reflector. That portion at which the anti-reflection area is provided may be a portion that is particularly susceptible to incident light, for example to incident sunlight. The position of the anti-reflection area will depend on several factors such as characteristics of secondary optics, critical angle of extraneous light, and viewing area to the observer. To decide where the anti-reflection area is best positioned, how big it is, and what form it has, one can use optical simulation software to arrive at a theoretical solution or one can build a prototype and take a look at where the main reflexes occur as a practical solution.

As shown in the specific embodiment of FIG. 11*a* a master reflector surrounds the LED 1. In that structure a metallized or reflective area 125 is provided on almost all sides of the LED 1. However an area 12*d* that is not reflective is also provided. That non-reflective area 120 can take the form of an area having a matte finish as shown in FIG. 11*a*, can be a dark area 121 as shown in FIG. 11*b*, or can be an omitted area 122 as shown in FIG. 11*c*, i.e. an area where there is no metallized area or reflective area. Utilizing any of the non-reflective area 120, dark area 121, or omitted area 122 spreads or absorbs incident extraneous light that otherwise would be reflected towards a viewer.

The embodiments noted above show the reflectors 11, 21, 31 as having generally smooth walls. However, the reflectors are not limited to such a structure.

Figure 12A:
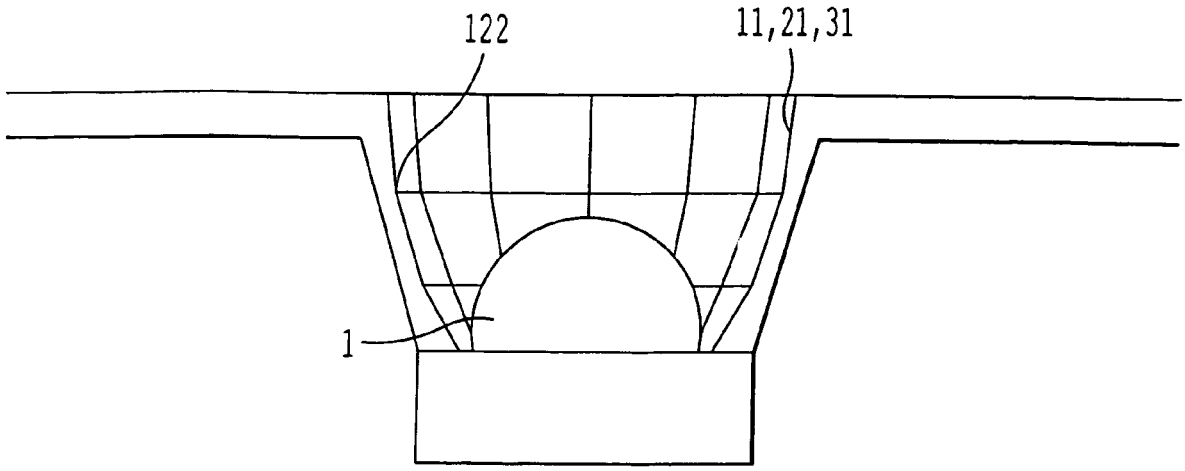
FIGS. 12*a* and 12*b* show a modification of a reflector structure of the present invention.
Figure 12B:
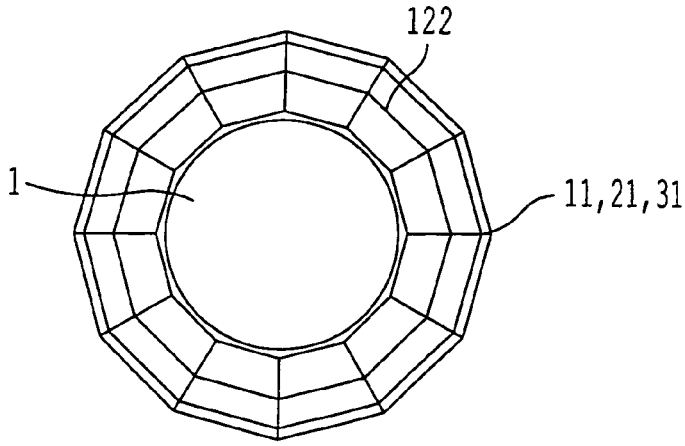

With reference to FIGS. 12*a* and 12*b*, the side reflective walls of any of the above-noted reflectors 11, 21, 31 can also include facets 122, FIG. 12*a* showing a side reflective wall of a reflector and an LED 1 from a side view and FIG. 12*b* showing the same LED 1 and reflector from a top view. As shown in FIGS. 12*a* and 12*b*, the side reflective walls of the reflector have facets 120.

As a further feature of the present invention, the side reflective walls of the reflectors can be utilized to capture a portion of light output from the corresponding surrounded LED to provide a general indication of light being output from the LEDs. Different embodiments of achieving such a result are shown in FIGS. 13*a*, 13*b*, and 14*a*, 14*b*.

Figure 13A:
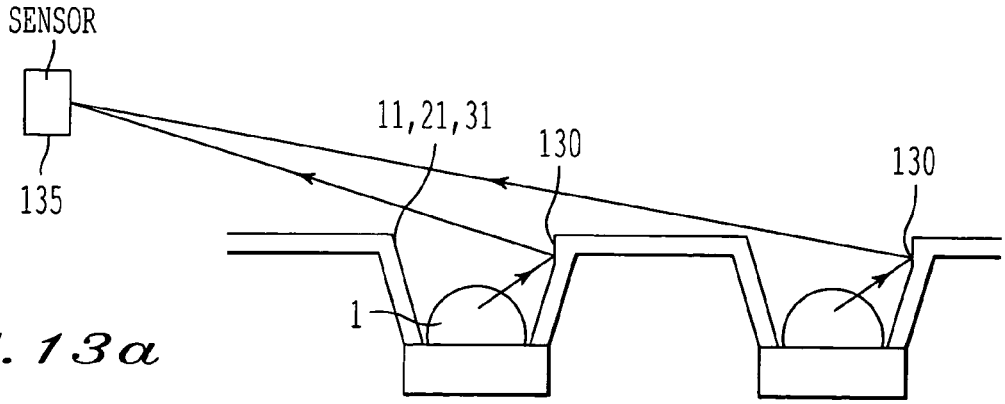
FIGS. 13*a* and 13*b* show a further modification of a reflector structure of the present invention.
Figure 13B:
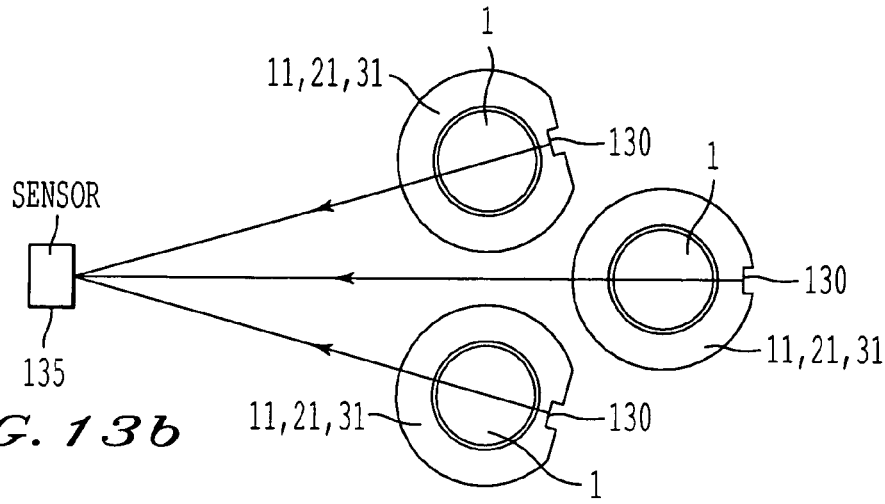

As shown in FIG. 13*a*, the side reflective walls of the reflector 11, 21, 31 include a specialized reflector zone 130. The specialized reflector zone 130 is positioned to reflect a small portion of light from the LED 1 specifically towards a light sensor 135. As shown in FIGS. 13*a* and 13*b*, different individual reflectors 11, 21, 31 include the same specialized reflector zone 130 and all output light to the same sensor 135. With such an operation it becomes possible to measure a defined percentage of luminance intensity of all of the LEDs. As shown in FIGS. 13*a* and 13*b*, the specialized reflector zones 130 are only a small portion of the reflectors 11, 21, 31 and thereby only a small amount of optical light is lost from being visible and is provided to the sensor 135. The light sensed at the sensor 135 can be utilized in, for example, an intensity feedback operation.

Figure 14A:
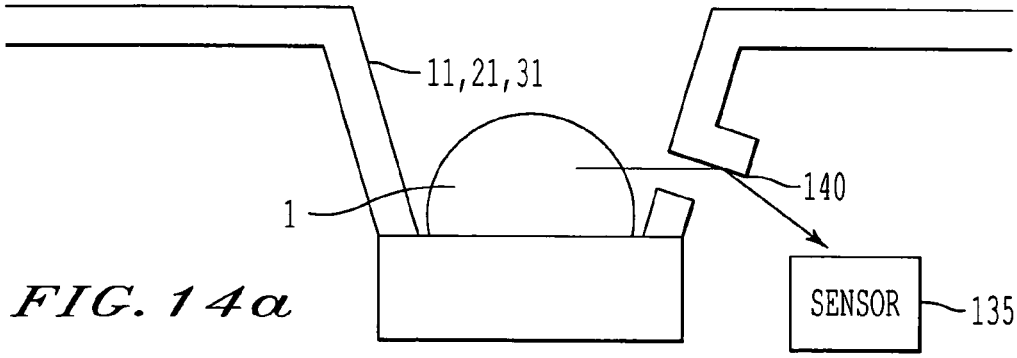
FIGS. 14*a* and 14*b* show a further modification of a reflector structure of the present invention.
Figure 14B:
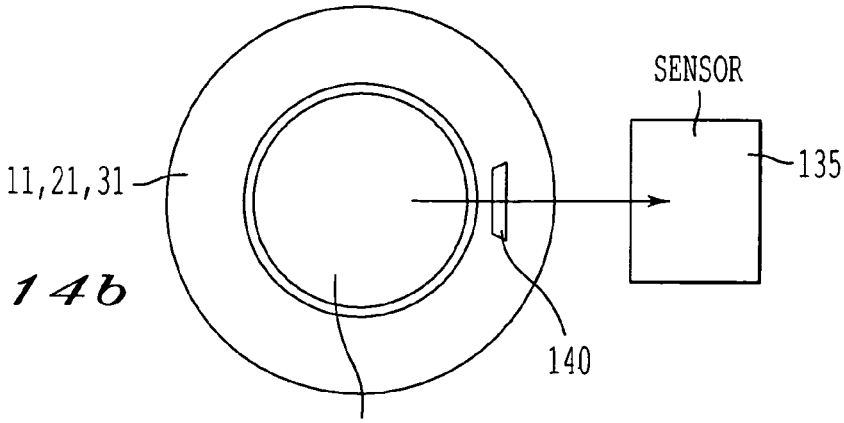

FIGS. 14*a* and 14*b* show an alternative structure to achieve the same result as shown in FIGS. 13*a* and 13*b*. In FIGS. 14*a* and 14*b*, the specialized reflector zone takes the shape of a small hole 140 provided in a wall of the reflector 11, 21, 31. A small portion of light from the LED 1 is then passed through the small hole 140 and provided to a sensor 135.

The above-noted structures can be applied to any or all of the reflectors 11, 21, 31, dependent on how precise an indication of output light is desired.

Obviously, numerous additional modifications and variations of the present invention are possible in light of the above teachings. It is therefore to be understood that within the scope of the appended claims, the present invention may be practiced otherwise than as specifically described herein.

The invention claimed is:

1. A light device comprising:

(a) a printed circuit board on which a plurality of light emitting diodes (LEDs) are mounted, a light intensity distribution output from the LEDs having 50% intensity values at about +/−60 degrees;

(b) a master reflector including a plurality of individual reflectors, one of said plurality of individual reflectors configured to surround at least one of the plurality of LEDs, each individual reflector including an opening through which a respective at least one of the plurality of LEDs can pass, and including reflective surfaces as sidewalls of the opening surrounding the respective at least one of the plurality of LEDs; and wherein one of the LEDs is placed in a center of a respective individual reflector at a position such that light output from the one LED beyond +/−50 degrees impinges on the reflective sidewalls to be reflected, and each individual reflector modifies a light intensity portion of the respective surrounded LED to provide a light output in which an intensity value near 0 degrees is about one-half intensity peaks beyond 20 degrees and beyond −20 degrees.

2. A light device according to claim 1, wherein said master reflector is made of molded plastic, and said reflective surfaces include an aluminum coating.

3. A light device according to claim 1, wherein each individual reflector surrounds plural of the respective plurality of LEDs arranged linearly.

4. A light device according to claim 1, wherein each individual reflector surrounds a single respective of the plurality of LEDs.

5. A light device according to claim 1, wherein each individual reflector has a conic cross-section.

6. A light device according to claim 1, wherein each individual reflector has a cross-section of a complicated curve.

7. A light device according to claim 1, wherein each individual reflector has an oval shape around an axis of the respective one of the plurality of LEDs.

8. A light device according to claim 1, further comprising;

(c) connecting screws configured to secure said printed circuit board to said master reflector.

9. A light device according to claim 1, further comprising:

(c) a lens mounted to said master reflector.

10. A light device according to claim 1, wherein at least one of said individual reflectors is unsymmetric relative to the respective surrounded LED.

11. A light device according to claim 1, further comprising:

(c) a light absorbing member extending from said master reflector.

12. A light device according to claim 1, wherein each individual reflector includes a light absorbing area.

13. A light reflector device according to claim 1, wherein each individual reflector has the reflective surfaces as one of smooth surfaces or faceted surfaces.

14. A light device according to claim 1, further comprising:

(b) a light sensor;

wherein each individual reflector includes on a reflective surface a specialized reflective zone to direct light to the light sensor.

15. A light device according to claim 1, the intensity peaks of the intensity pattern are located at approximately +35 degrees and −35 degrees.

16. A light device comprising:

(a) means for supporting a plurality of light emitting diodes (LEDs), a light intensity distribution output from the LEDs having 50% intensity values at about +/−60 degrees;

(b) master reflecting means including a plurality of individual reflecting means, one of said plurality of individual reflecting means including an opening through which a respective at least one of the plurality of LEDs can pass, and including reflective surfaces as sidewalls of the opening surrounding at least one of the plurality of LEDs and for reflecting light output from the respective at least one of the plurality of LEDs; and wherein one of the LEDs is placed in a center of a respective individual reflecting means at a position such that light output from the one LED beyond +/−50 degrees impinges on the reflective sidewalls to be reflected, and each individual reflecting means modifies a light intensity portion of the surrounded LED to provide a light output in which an intensity value near 0 degrees is about one-half intensity peaks beyond 20 degrees and beyond −20 degrees.

17. A light device according to claim 16, further comprising:

(c) means for securing said means for supporting to said master reflecting means.

18. A light device according to claim 16, further comprising:

(c) optic means mounted to said master reflecting means.

19. A light device according to claim 16, further comprising:

(c) light absorbing means for absorbing impinging light.

20. A light device according to claim 16, further comprising:

(b) a light sensor;

wherein each individual reflector includes on a reflective surface a specialized reflective zone to direct light to the light sensor.

21. A light device according to claim 16, the intensity peaks of the intensity pattern are located at approximately +35 degrees and −35 degrees.

* * * * *